US011658447B2

(12) United States Patent
Xu

(10) Patent No.: US 11,658,447 B2
(45) Date of Patent: May 23, 2023

(54) PIN-TYPE LED LAMP HOLDER AND MANUFACTURING METHOD OF THE SAME

(71) Applicant: Shenzhen Leshida Lighting Co., Ltd., Shenzhen (CN)

(72) Inventor: Xiaojun Xu, Jiangmen (CN)

(73) Assignee: SHENZHEN LESHIDA LIGHTING CO., LTD., Shenzhen (CN)

( * ) Notice: Subject to any disclaimer, the term of this patent is extended or adjusted under 35 U.S.C. 154(b) by 226 days.

(21) Appl. No.: 17/115,754

(22) Filed: Dec. 8, 2020

(65) Prior Publication Data

US 2022/0140555 A1 May 5, 2022

(30) Foreign Application Priority Data

Nov. 5, 2020 (CN) ..... 202011224647.4

(51) Int. Cl.

| | |
|---|---|
| ***H01R 13/60*** | (2006.01) |
| ***H01R 33/05*** | (2006.01) |
| ***F21V 23/06*** | (2006.01) |
| ***H01R 13/10*** | (2006.01) |
| ***H01R 13/504*** | (2006.01) |
| ***H01R 33/22*** | (2006.01) |
| ***H01R 43/20*** | (2006.01) |
| *F21Y 115/10* | (2016.01) |

(52) U.S. Cl.

CPC ..... *H01R 33/05* (2013.01); *F21V 23/06* (2013.01); *H01R 13/10* (2013.01); *H01R 13/504* (2013.01); *H01R 33/22* (2013.01); *H01R 43/20* (2013.01); *F21Y 2115/10* (2016.08)

(58) Field of Classification Search

CPC ..... F21S 8/065; F21S 4/003; H01R 4/2408; F21V 21/116; F21V 17/06; F21V 1/00

See application file for complete search history.

(56) References Cited

U.S. PATENT DOCUMENTS 5,398,180 A * 3/1995 Lee ..... F21V 19/0005 362/431

6,135,623 A * 10/2000 Lin ..... F21V 17/14 362/431

* cited by examiner

*Primary Examiner* — Phuong Chi Thi Nguyen

(57) ABSTRACT

The present disclosure provides a pin-type LED lamp holder including: a connector, a first lead wire, a second lead wire, a first fixing tube and a second fixing tube, the connector provided with a first hole and a second hole through the entire connector, the first fixing tube and the first lead wire fixedly connected and plugged into the first hole, and the second fixing tube and the second lead wire fixedly connected and plugged into the second hole. In this way, the first fixing tube and the second fixing tube can be wrapped by the connector and insulated well, thereby a risk of electric shock is prevented.

6 Claims, 6 Drawing Sheets

PIN-TYPE LED LAMP HOLDER AND MANUFACTURING METHOD OF THE SAME

CROSS-REFERENCE TO RELATED APPLICATIONS

This application claims priority to Chinese Patent Application No. 202011224647.4, filed Nov. 5, 2020, the contents of which are incorporated herein by reference.

BACKGROUND

1. Technical Field

The present disclosure relates to a field of lamp technology, especially to a pin-type LED lamp holder and a manufacturing method thereof.

2. Description of Related Art

A lamp is a device that may have light transmitted through, distribute light and change light distribution of a light source, including all parts and components needed to fix and protect the light source, as well as wiring accessories necessary for connection with a power supply. The lamp enables the light source to reliably emit light to meet a human' needs for light in various activities. In addition to an electrical light source, a modern electrical lamp further includes an optical component, an electrical component and a mechanical component. Most holders of lamps are not waterproof, and need to be fixed by such a mechanical structure as a screw. In order to address the above problems, a patent document with an application number CN201920899185.2 proposes a new pin-type LED lamp holder. In the new pin-type LED lamp holder, there are not many differences between a first cover and a second cover, facilitating design and manufacture of a mold. Compared with traditional fixing by using a screw, use of ultrasonic sealing results in good fixing. A cooperation of a convex rib with a sealing groove has a waterproof function. An inner edge is advantageous for preventing water flow from seeping into a gap between a side tube and a conductive wire, and meanwhile, may tighten the conductive wire. The new pin-type LED lamp holder is complex in structure and processing, and is costly in an ultrasonic sealing process. Moreover, because the lamp holder is exposed at a part connecting to the pin-type LED lamp, and it is easy to touch a conductive part when the LED lamp is being plugged, it is likely to risk electric shock.

DETAILED DESCRIPTION

The present application will be further described below with reference to the accompanying drawings for further clearly and fully discussing the technical solutions of the present disclosure.

Embodiment One

Figure 1:
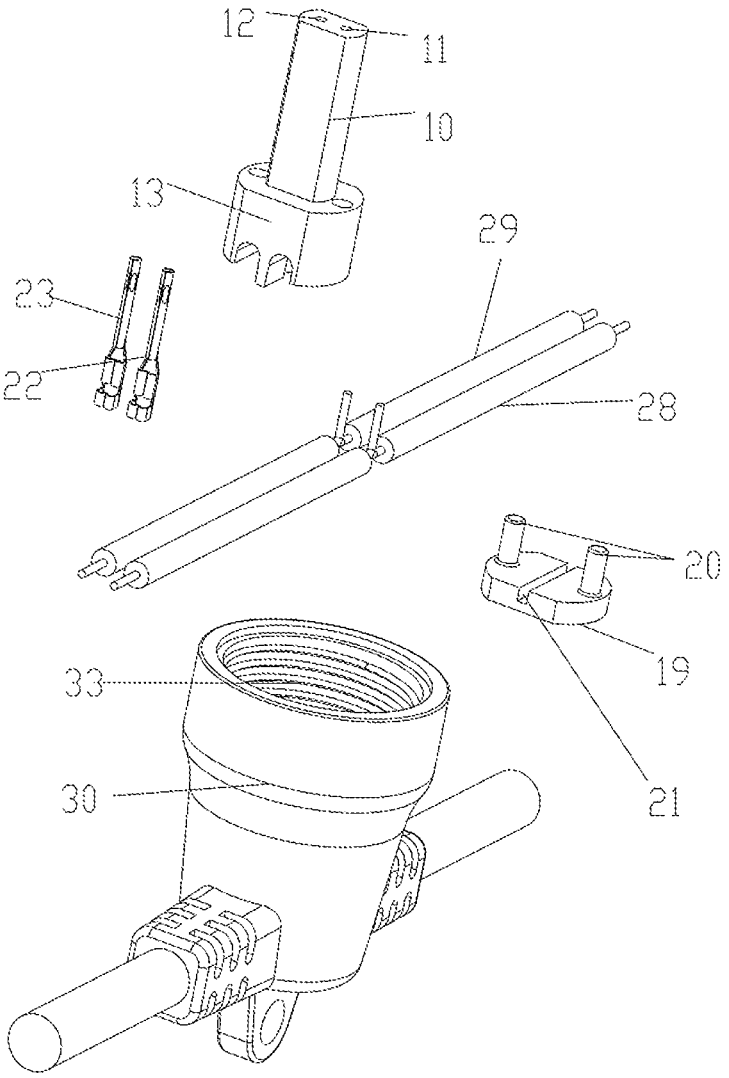
FIG. 1 shows an exploded view of a pin-type LED lamp holder in Embodiment One in the present disclosure.
Figure 2:
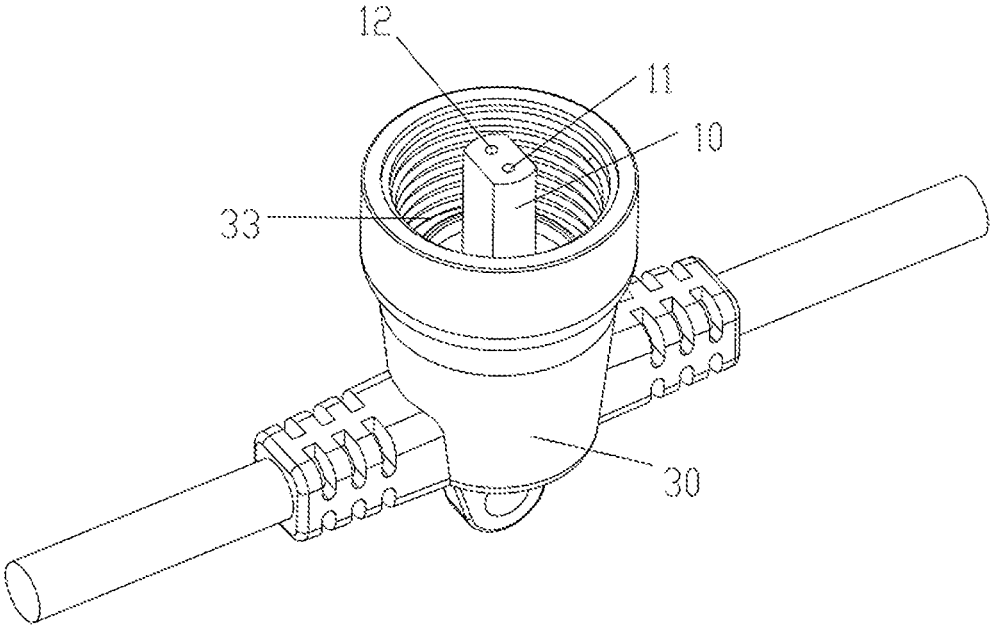
FIG. 2 shows a schematic view of a structure of the pin-type LED lamp holder in Embodiment One in the present disclosure.
Figure 3:
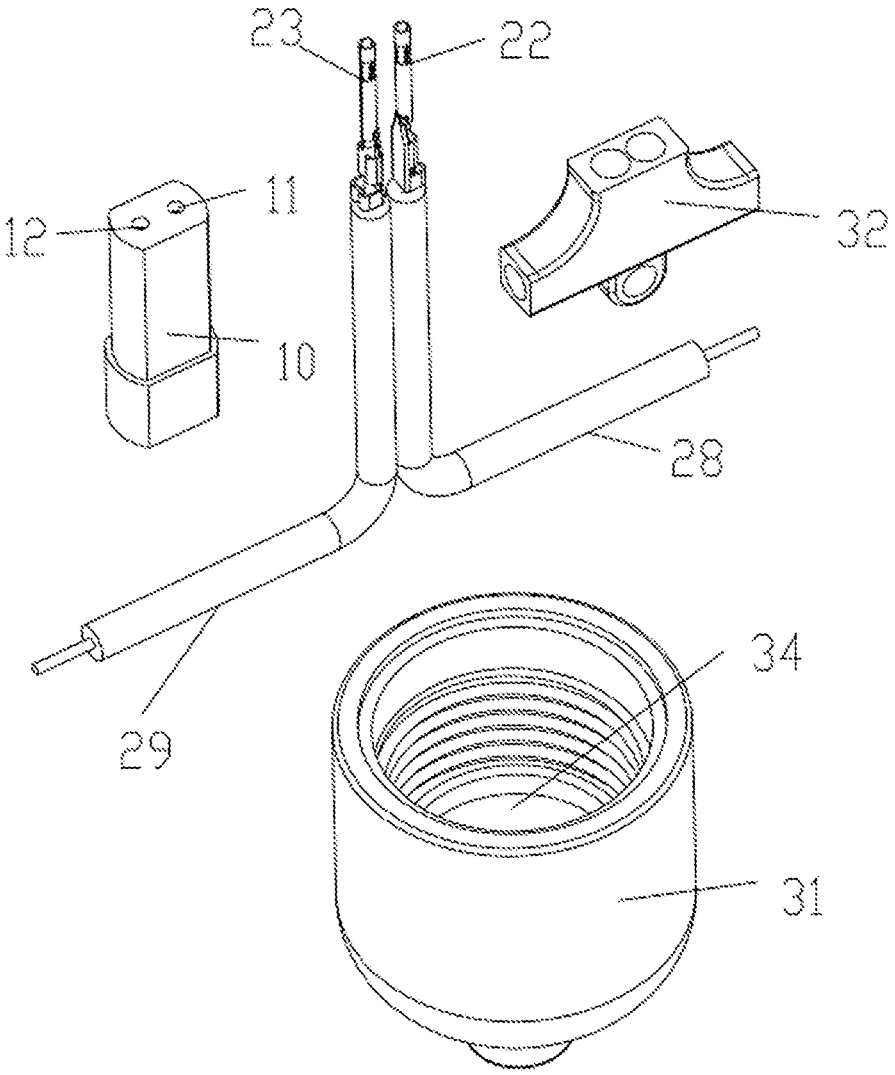
FIG. 3 shows an exploded view of a pin-type LED lamp holder in Embodiment Two in the present disclosure.
Figure 4:
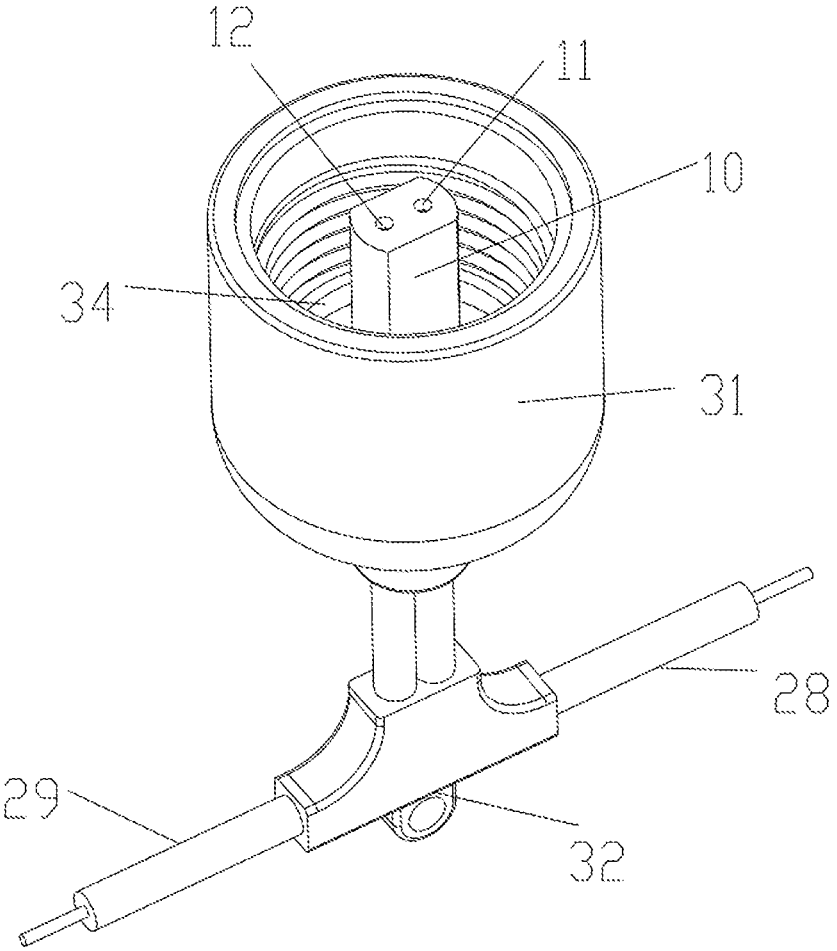
FIG. 4 shows a schematic view of a structure of the pin-type LED lamp holder in Embodiment Two in the present disclosure.
Figure 5:
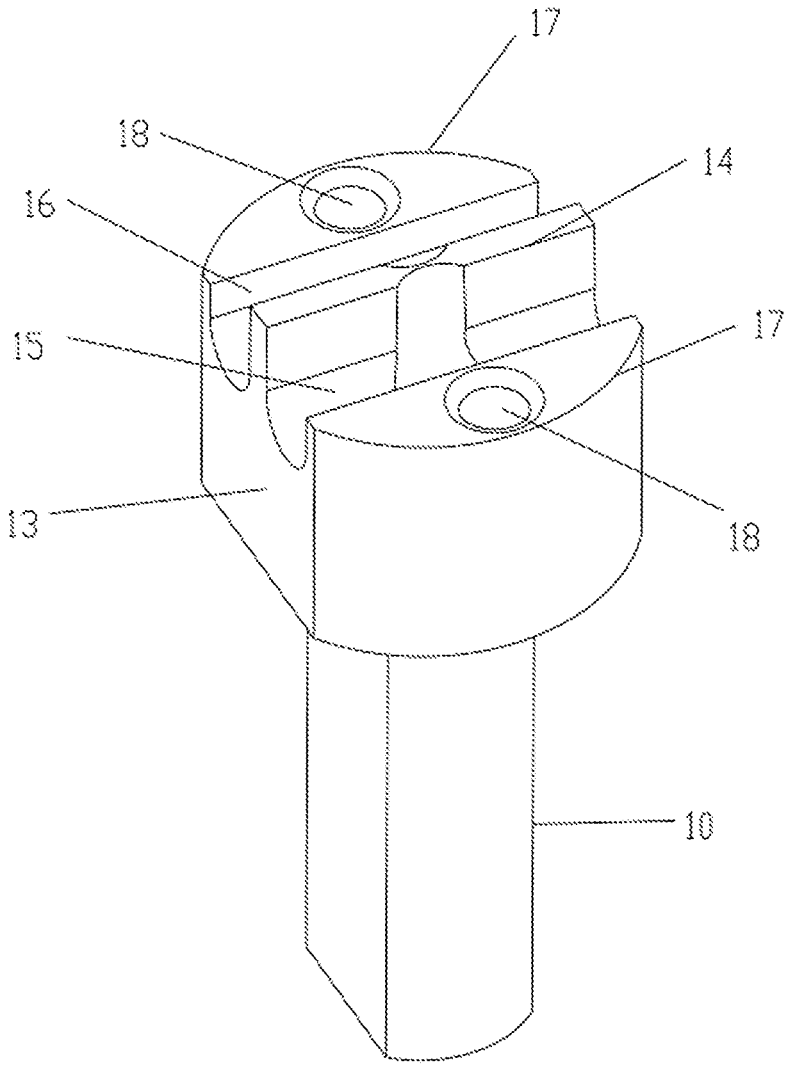
FIG. 5 is a schematic view of a structure when a mounting head and a connector are connected in the present disclosure.
Figure 6:
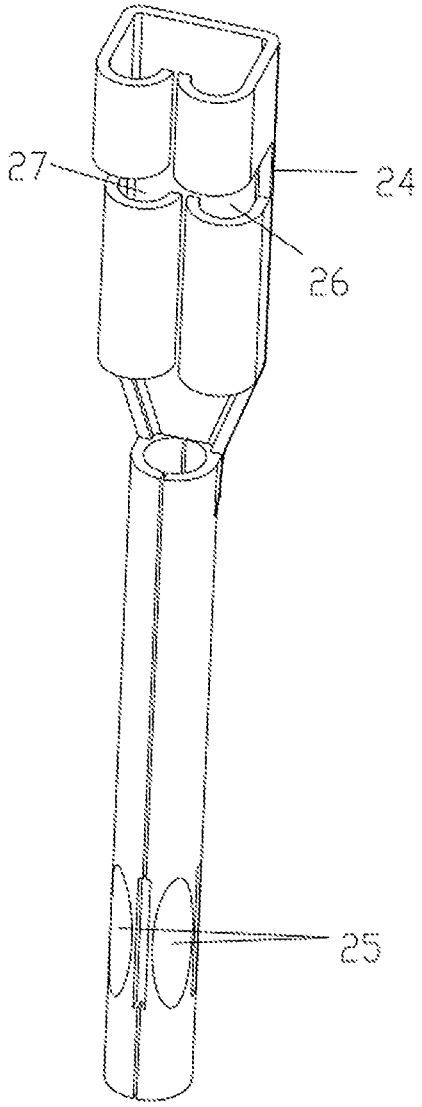
FIG. 6 is a schematic view of a structure of a fixing tube in the present disclosure.

With reference to FIGS. 1 to 6, the present disclosure provides a pin-type LED lamp holder including a connector 10, a first lead wire 28, a second lead wire 29, a first fixing tube 22 and a second fixing tube 23, the connector 10 provided with a first hole 11 and a second hole 12 through the entire connector 10, the first fixing tube 22 and the first lead wire 28 fixedly connected and plugged into the first hole 11, and the second fixing tube 23 and the second lead wire 29 fixedly connected and plugged into the second hole 12. The first fixing tube 22 and the second fixing tube 23 are identical in terms of shape and structure, each of the first fixing tube 22 and the second fixing tube 23 is provided with a double-wire lug 24 and a window 25, the double-wire lug 24 provided with a first holding groove 26 and a second holding groove 27 to hold a lead wire, and a tube wall being concave at the window 25. The pin-type LED lamp holder further includes a mounting head 13 fixedly connected to an end of the connector 10. The mounting head 13 is provided with a separating plate 14 and two fixing blocks 17, the separating plate 14 disposed between the two fixing blocks 17 to form a first groove 15 and a second groove 16, a central position of the first groove 15 being in communication with the first hole 11, and a central position of the second groove 16 being in communication with the second hole 12.

In this embodiment, the first hole 11 and the second hole 12 are identical with an upper part wider than a lower part. A fixing tube is of the same structure of an upper part wider than a lower part, and the fixing tube may generally be fixed in a hole after the fixing tube is plugged into the hole. Both ends of either of the first lead wire 28 and the second lead wire 29 have two connecting wires respectively from the fixing tube. In this way, the lamp holder may be connected in parallel or in series with another identical lamp holder. The double-wire lug 24 provided on the fixing tube enables the fixing tube to have two lead wires led out. The tube wall of the window 25 is concave, so that the fixing tube, when connecting a pin-type LED lamp, can fix a connecting lamp foot better so that it is not easy for the lamp foot to escape from the fixing tube. The central position of the first groove 15 is in communication with the first hole 11, and the central position of the second groove 16 is in communication with the second hole 12. The first lead wire 28 and the second lead wire 29 are lead out through the grooves.

In addition, the pin-type LED lamp holder further includes a cover plate 19 provided with fixing pillars 20 and a groove 21, the fixing pillars 20 plugged into fixing holes 18 provided in the fixing blocks 17, and a top end of the separating plate 14 clamped in the groove 21.

In this embodiment, the fixing pillars 20 and the groove 21 provided on the cover plate 19 double fix the cover plate 19 and the mounting head 13, thereby wires are compressed better.

In addition, the pin-type LED lamp holder further includes a first injection-molded member 30 integrally formed, the first injection-molded member 30 totally wrapping the mounting head 13 and part of the connector 10, the first injection-molded member 30 provided with a first accommodating cavity 33 with screw threads on an inner wall of the first accommodating cavity 33, the connector 10 partially accommodated in the first accommodating cavity 33, and the first lead wire 28 and the second lead wire 29 extending to periphery of the first injection-molded member 30.

In this embodiment, the first injection-molded member 30 is provided with screw threads to facilitate screwing between the lamp holder and a protection shield. In this way, when the pin-type LED lamp is installed on the pin-type LED lamp holder, the holder may be screwed to the protection shield, so that the LED lamp connected to the lamp holder is better protected.

In addition, all of the connector 10, the mounting head 13, the cover plate 19, the first injection-molded member 30 and a second injection-molded member 31 are made of an insulation material.

The present disclosure further provides a manufacturing method of the pin-type LED lamp holder, including the following processing steps:

S1: fixedly electrically connecting the first lead wire 28 to the first fixing tube 22, the second lead wire 29 to the second fixing tube 23, and then plugging the first fixing tube 22 into the first hole 11, and the second fixing tube 23 into the second hole 12;

S2: pressing the first lead wire 28 and the second lead wire 29 in a direction of the first groove 15 and the second groove 16, and then fixedly installing the cover plate 19 and the mounting head 13, the lead wires tightly pressed in the grooves by the cover plate 19; and S3: installing a structure completed assembling in S2 into a mold of the first injection-molded member 30, then performing injection molding to form the first injection-molded member 30, and demolding to form a completed structure of the first injection-molded member 30.

Embodiment Two

This embodiment is distinguished from Embodiment One in that a pin-type LED lamp holder in Embodiment Two does not include a mounting head 13, but two lead wires are led out directly through a connector 10, and then a complete pin-type LED lamp holder is produced in an integral manner through a second injection-molded member 31.

With reference to FIGS. 1 to 6, the present disclosure provides a pin-type LED lamp holder including the connector 10, a first lead wire 28, a second lead wire 29, a first fixing tube 22 and a second fixing tube 23, the connector 10 provided with a first hole 11 and a second hole 12 through the entire connector 10, the first fixing tube 22 and the first lead wire 28 fixedly connected and plugged into the first hole 11, and the second fixing tube 23 and the second lead wire 29 fixedly connected and plugged into the second hole 12. The pin-type LED lamp holder further comprises a second injection-molded member 31 integrally formed and a wire guide 32, the second injection-molded member 31 partially wrapping the connector 10, the second injection-molded member 31 provided with a second accommodating cavity 34 having screw threads on an inner wall of the second accommodating cavity 34, the connector 10 partially accommodated in the second accommodating cavity 34, and the wire guide 32 fixing and guiding the first lead wire 28 and the second lead wire 29 extending from the second injection-molded member 31.

In this embodiment, the wire guide 32 is provided with two through holes capable of turning directions. When a lead wire is plugged into one of the through holes, a direction of the lead wire may be changed by the wire guide 32, and then the lead wire may be connected to a circuit. The second injection-molded member 31 has a same function as the first injection-molded member 30, and is also provided with screw threads to be connected to a protection shield.

The present disclosure further provides a manufacturing method of the pin-type LED lamp holder, including the following processing steps:

S1: fixedly electrically connecting the first lead wire 28 to the first fixing tube 22, the second lead wire 29 to the second fixing tube 23, and then plugging the first fixing tube 22 into the first hole 11, and the second fixing tube 23 into the second hole 12;

S2': installing the structure completed assembling in S1 into a mold of the second injection-molded member 31, then performing injection molding to form the second injection-molded member 31, and demolding to form a completed structure of the second injection-molded member 31;

S3': threading a lead wire extending from the second injection-molded member 31 through the wire guide 32 to complete guide of the lead wire to obtain a completed article of the pin-type LED lamp holder.

Compared with the processing steps in Embodiment One, the processing steps in Embodiment Two do not include assembling a mounting head 13, but the lead wires are led out directly from the connector 10, and the wire guide 32 is further connected after the second injection-molded member 31 is lead out.

It should be noted that the present application may have other various embodiments. Modifications and variations made by those skilled in the art based on the embodiments according to the present application without any creative work also fall within the scope of the present application.

What is claimed is:

1. A pin-type LED lamp holder, comprising: a connector, a first lead wire, a second lead wire, a first fixing tube and a second fixing tube, the connector provided with a first hole and a second hole through the entire connector, the first fixing tube directly fixed to the first lead wire and plugged into the first hole, and the second fixing tube directly connected to the second lead wire and plugged into the second hole;

wherein the pin-type LED lamp holder further comprises a mounting head fixedly connected to an end of the connector;

wherein the mounting head is provided with a separating plate and two fixing blocks, the separating plate disposed between the two fixing blocks to form a first groove and a second groove, a central position of the first groove being in communication with the first hole, and a central position of the second groove being in communication with the second hole.

2. The pin-type LED lamp holder according to claim 1, wherein the first fixing tube and the second fixing tube are identical in terms of shape and structure, each of the first fixing tube and the second fixing tube is provided with a double-wire lug and a window, the double-wire lug provided with a first holding groove and a second holding groove to hold a lead wire, and a tube wall being concave at the window.

3. The pin-type LED lamp holder according to claim 1, wherein all of the connector, the mounting head, the cover plate, the first injection-molded member and the second injection-molded member are made of an insulation material.

4. The pin-type LED lamp holder according to claim 1, wherein the pin-type LED lamp holder further comprises a cover plate provided with fixing pillars and a groove, the fixing pillars plugged into fixing holes provided in the fixing blocks, and a top end of the separating plate clamped in the groove.

5. The pin-type LED lamp holder according to claim 4, wherein the pin-type LED lamp holder further comprises a first injection-molded member integrally formed, the first injection-molded member totally wrapping the mounting head and part of the connector, the first injection-molded member provided with a first accommodating cavity with screw threads on an inner wall of the first accommodating cavity, the connector partially accommodated in the first accommodating cavity, and the first lead wire and the second lead wire extending to periphery of the first injection-molded member.

6. A method for manufacturing a pin-type LED lamp holder, the pin-type LED lamp holder comprising a connector, a first lead wire, a second lead wire, a first fixing tube and a second fixing tube, the connector provided with a first hole and a second hole through the connector, the first fixing tube directly fixed to the first lead wire and plugged into the first hole, and the second fixing tube directly connected to the second lead wire and plugged into the second hole; wherein the pin-type LED lamp holder further comprises a mounting head fixedly connected to an end of the connector; the mounting head is provided with a separating plate and two fixing blocks, the separating plate disposed between the two fixing blocks to form a first groove and a second groove, a central position of the first groove being in communication with the first hole, and a central position of the second groove being in communication with the second hole; the pin-type LED lamp holder further comprises a cover plate provided with fixing pillars and a groove, the fixing pillars plugged into fixing holes provided in the fixing blocks, and a top end of the separating plate clamped in the groove, the method comprising the following processing steps:

S1: fixedly electrically connecting the first lead wire to the first fixing tube, the second lead wire to the second fixing tube, and then plugging the first fixing tube into the first hole, and the second fixing tube into the second hole;

S2: pressing the first lead wire and the second lead wire in a direction of the first groove and the second groove, and then fixedly installing the cover plate and the mounting head, the lead wires tightly pressed in the grooves by the cover plate; and S3: installing a structure completed assembling in S2 into a mold of the first injection-molded member, then performing injection molding to form the first injection-molded member, and demolding to form a completed structure of the first injection-molded member.

* * * * *